United States Patent [19]

Williams et al.

[11] 3,949,530

[45] Apr. 13, 1976

[54] CORNER FORMATION FOR ARCHITECTURAL GLAZING STRIP

[75] Inventors: Fred Williams, Pittsford; Charles Yackiw, Fairport, both of N.Y.

[73] Assignee: Schlegel Corporation, Rochester, N.Y.

[22] Filed: Sept. 16, 1974

[21] Appl. No.: 506,115

[52] U.S. Cl. ..... 52/288; 49/479; 52/658; 52/741; 161/89; 264/145; 264/261; 428/53; 428/58; 428/295

[51] Int. Cl.[2] ..... E04B 1/66; E04C 2/22

[58] Field of Search ..... 52/288, 100, 741, 658, 52/746, 403, 631, 716, 99; 264/138, 145, 261; 49/475, 479; 161/89, 149

[56] References Cited

UNITED STATES PATENTS

| | | | |
|---|---|---|---|
| 839,214 | 12/1906 | Sheehan | 161/89 |
| 1,278,111 | 9/1918 | Cummings | 264/261 |
| 2,064,823 | 12/1936 | Creamer | 52/716 |
| 2,794,221 | 6/1957 | Bedics | 49/479 |
| 2,884,669 | 5/1959 | Hillson | 52/288 |
| 3,009,216 | 11/1961 | Kimber | 52/403 X |
| 3,286,405 | 11/1966 | Schembri | 52/656 X |
| 3,350,825 | 11/1967 | Rillo | 52/288 |
| 3,394,044 | 7/1968 | Bright | 52/716 |
| 3,451,178 | 6/1969 | Beale | 52/288 X |

FOREIGN PATENTS OR APPLICATIONS

| | | | |
|---|---|---|---|
| 556,595 | 10/1943 | United Kingdom | 52/656 |
| 285,903 | 9/1952 | Switzerland | 49/479 |
| 1,217,411 | 5/1960 | France | 49/479 |

*Primary Examiner*—Ernest R. Purser
*Assistant Examiner*—Leslie A. Braun
*Attorney, Agent, or Firm*—George W. Shaw

[57] ABSTRACT

A corner formation is made in an architectural glazing strip that has an elastomer-encased spring material formed of a resilient wire element in a transverse pattern of zig-zag loops with the strip having an anchorage edge and a glass-engaging edge. The strip is cut inward from the anchorage edge between the pair of wire loops that occur at the corner, and the cut is stopped at the wire extending between the pair of loops. Then the strip is bent 90° at the corner to open a substantially square space between the wire loops. A resilient element is placed in this space and has the transverse cross-sectional shape of the spring material, and an elastomeric material encases the resilient element and is secured to the strip around the corner. The result provides an even and uniform corner having resilient pressure all the way around the corner.

5 Claims, 5 Drawing Figures

CORNER FORMATION FOR ARCHITECTURAL GLAZING STRIP

THE INVENTIVE IMPROVEMENT

Corner formations for architectural glazing strips are troublesome. If they are formed at the building site and require skilled labor including accurate cutting and fitting together of parts and any caulking or sealing, they lead to difficulties when these operations are not performed properly. Also, the corners are weak spots generally where the seal against the glass is less secure, and leaks and looseness are most likely to occur.

The invention involves realization of an especially advantageous way to form a corner in a particular type of architectural glazing strip. The invention aims at an even and continuous corner that is easily and reliably made and provides a firm and resilient grip and seal around the corner, to provide low-cost, efficiency, and reliability.

SUMMARY OF THE INVENTION

The inventive corner formation includes a structure and a method and is applied to an architectural glazing strip having a spring material formed of a resilient wire element in a transverse pattern of zig-zag loops encased in an elastomeric cover to have an anchorage edge and a glass-engaging edge. The pair of wire loops occurring at the corner and the elastomeric cover over this pair of loops is spread apart about 90° to open a substantially square space at the corner and to leave an unbroken length of the wire extending around the inside of the corner between the spread-apart loops in the region of the glass-engaging edge. A substantially square, resilient element having approximately the transverse cross-sectional shape of the spring material is positioned in the square space between the spread-apart loops, and an elastomeric material is used to encase the resilient element and to secure to the strip around the corner. The spreading of the pair of loops at the corner is accomplished by cutting the strip at the corner from the anchorage edge inward between the pair of loops and stopping the cut at the wire extending between the pair of loops, and this is easily done because the elastomeric material covering the pair of loops cuts far more readily than the spring wire loops themselves.

DRAWINGS

Figure 3:
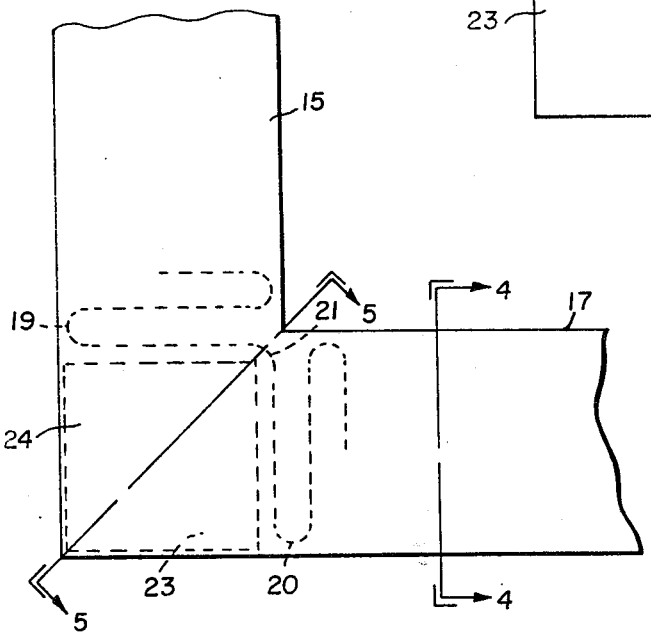
Figure 4:
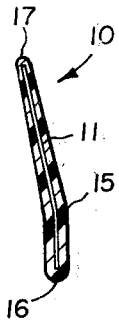
Figure 5:
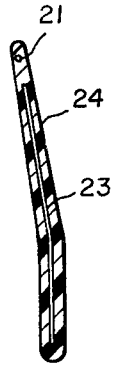

FIG. 3 is a partially schematic, fragmentary elevational view of the completed corner formation; and FIGS. 4 and 5 are cross-sectional views of the corner formation of FIG. 3 taken respectively along the lines 4—4 thereof and 5—5 thereof.

DETAILED DESCRIPTION

Figure 1:
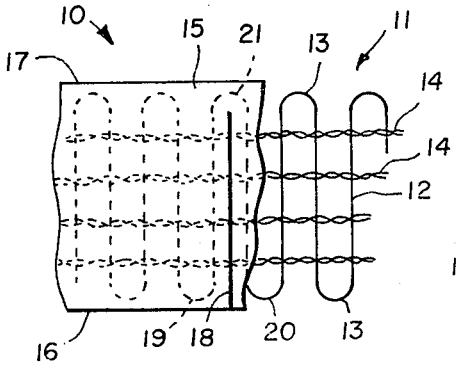
FIG. 1 is a partially schematic, fragmentary elevational view of a preferred embodiment of architectural glazing strip cut at the proper place to form the inventive corner.

FIG. 1 best shows the type of architectural glazing strip 10 used in forming the inventive corner. Strip 10 is formed of a spring material 11 formed of a resilient wire element 12 laid in a transverse pattern of zig-zag loops 13 which are linked together by rows of longitudinally extending knitted strands 14. Wire element 12 is preferably metallic and springy and is preferably formed of a material such as a high-carbon steel. The resilience of spring material 11 is controlled in part by the tensile strength of wire element 12, the diameter of wire element 12, and the number of loops 13 per unit of length of spring material 11.

Spring material 11 is encased in an elastomeric covering material 15 that is preferably extruded onto spring material 11 and preferably completely covers and encases spring material 11. Strip 10 has an anchorage edge 16 and a glass-engaging edge 17 and is designed for anchoring in a slot or other support around the periphery of a glass panel to press edge 17 tightly and firmly against the glass to seal the strip against the glass and hold the glass securely in place and also seal strip 10 against a slot or other support holding anchoring edge 16. The pressure of the gripping seal against the glass panel is controlled by adjusting the springiness and resilience of spring material 11 as described above.

To make the inventive corner in strip 10 it is first necessary to locate the place along strip 10 where the corner should be formed, and then make a cut 18 extending from anchorage edge 16 toward glass-engaging edge 17 between the pair of loops 19 and 20 that occur at the corner location. Cut 18 extends through linking strands 14, and stops at the wire 21 extending between loops 19 and 20. Cut 18 is easily located in such a position because elastomeric material 15 and linking strands 14 cut far more readily and easily than wire element 12, and a cutting knife naturally seeks the space between loops 19 and 20, and naturally stops at wire 21 linking loops 19 and 20 together, so long as relatively little force is used. Cut 18 can easily be made with a hand-held knife, for example, or strip 10 can be manually pressed against a fixed knife edge relatively lightly to drive the knife edge between loops 19 and 20 and up to engagement with wire 21.

Figure 2:
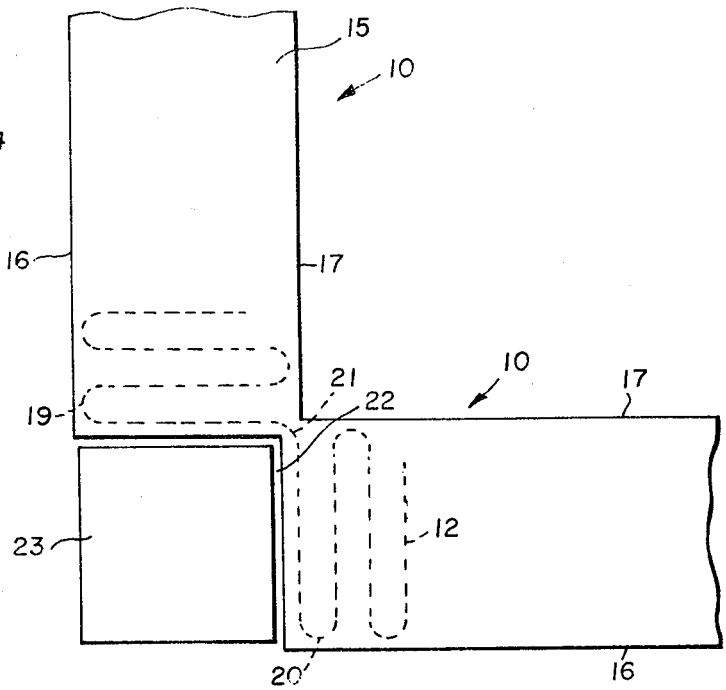
FIG. 2 is a partially schematic, fragmentary elevational view of the next step in the construction of the inventive corner.

Then strip 10 is bent approximately 90° to the position shown in FIG. 2 to spread apart loops 19 and 20 and open up a substantially square space 22 between loops 19 and 20 at the corner to be formed. Wire element 21 extending between loops 19 and 20 is intact and unbroken around the inside of the corner in the region of glass-engaging edge 17 to strengthen and support the relatively thin uncut piece of strip 10 at the corner. Wire 21 insures that spring material 11 is unbroken at the corner and that strip 10 cannot pull apart at the corner in spite of cut 18, and wire 21 also helps supply the general resilient pressure of spring material 11 to a glass panel at the corner.

A square resilient element 23 is then placed in square space 22 between right-angled loops 19 and 20, and element 23 is preferably formed of spring metal and preferably has substantially the same cross-sectional shape as spring material 11. Element 23 then provides the resilient gripping force at the corner in the same sort of way that spring material 11 applies the basic gripping force along the length of strip 10.

Then an elastomeric material 24 is coated over resilient element 23 and secured to elastomeric material 15 covering spring material 11 of strip 10 so that elastomeric material encases the corner and extends evenly and uniformly around the corner. Elastomeric material 24 is preferably coated over spring element 23 and vulcanized in place to make a smooth and even corner.

FIGS. 4 and 5 show one example of a preferred cross-sectional shape for strip 10 and the inventive corner, and show that resilient element 23 has approximately the same cross-sectional shape as spring material 11. The cross section of FIG. 5 also shows uncut wire 21 extending around the inside of the corner to join the portions of spring element 11 on each side of the corner.

The inventive corner is preferably made in a factory where all four corners are made from a single length of glazing strip 10 to the required size of a window glass to be installed in a building. Because strip 10 is flexible, a rectangular glazing strip frame completed at the factory can be folded up or rolled up and shipped in a reasonable sized and convenient package to the building site where the glazing strip frame is unrolled or unfolded and applied around a window glass panel of predetermined size. Strip 10 is then pressed in place in an anchorage around the glass panel with the inventive corners located at the corners of the glass panel for a firm gripping seal with the glass panel that continues through the corners because of the presence of wire 21, loops 19 and 20, and spring element 23 located at the corner.

Those skilled in the art will appreciate that many different cross-sectional shapes for strip 10 can be used and that strip 10 can be anchored in place around a glass panel in a variety of ways. Many of all these possibilities can use the inventive corner by applying a suitable shaped resilient element in an opening formed by cutting the strip as described. Also, many different materials can be used, and construction operations can be varied to suit the materials and structures involved.

We claim:

1. A corner formation for an architectural glazing strip having a spring material formed of a resilient wire element in a transverse pattern of zig-zag loops encased in an elastomeric cover to have an anchorage edge region and a glass-engaging edge region, said wire loops extending from said anchorage edge region into said glass engaging edge region, said corner formation comprising:

a. the pair of said wire loops occurring at said corner and said elastomeric cover over said pair of loops being spread apart about 90° to open a substantially square space at said corner with an unbroken length of said wire extending around the inside of said corner between said pair of loops in the region of said glass-engagind edge;

b. a substantially square, resilient element having approximately the transverse cross-sectional shape of said spring material being positioned in said square space between said spread-apart loops; and c. elastomeric material encasing said resilient element and secured to said strip around said corner.

2. The corner formation of claim 1 wherein said resilient element is spring metal.

3. The corner formation of claim 1 wherein said wire element is metallic.

4. The corner formation of claim 3 wherein said resilient element is spring metal.

5. A method of forming a corner for an architectural glazing strip having a spring material formed of a resilient wire element in a transverse pattern of zig-zag loops encased in an elastomeric cover to have an anchorage edge and a glass-engaging edge, said corner forming method comprising:

a. cutting said strip at said corner between a pair of said loops so said cut extends from said anchorage edge of said strip toward said glass-engaging edge of said strip;

b. stopping said cut at the wire extending between said pair of loops in the region of said glass-engaging edge so said wire extends around the inside of said corner between said pair of loops;

c. bending said strip at said cut by approximately 90° to open up a substantially square space at said corner;

d. placing a substantially square resilient element having approximately the transverse cross-sectional shape of said spring material in said corner space formed by bending said strip; and e. encasing said resilient element in an elastomeric cover secured to said strip around said corner.

* * * * *